United States Patent [19]

Hettinger

[11] 4,449,253

[45] May 22, 1984

[54] QUICK EVACUATION FIREMAN'S COAT

[76] Inventor: Lon J. Hettinger, 605 N. H St., Imperial, Calif. 92251

[21] Appl. No.: 302,871

[22] Filed: Sep. 16, 1981

[51] Int. Cl.[3] ..... A41D 1/00
[52] U.S. Cl. ..... 2/93; 2/94
[58] Field of Search ..... 2/DIG. 6, 93, 94, 271; 182/3

[56] References Cited

U.S. PATENT DOCUMENTS 3,997,921 12/1976 Knight ..... 2/93
4,168,544 9/1979 Kallman ..... 2/94

*Primary Examiner*—Doris L. Troutman
*Attorney, Agent, or Firm*—Charmasson & Holz

[57] ABSTRACT

A fireman's coat is modified by the addition of several emergency evacuation straps along the sides, the tops of the shoulders, and behind the neck, to permit a fireman overcome by smoke or otherwise incapacitated to be effectively and quickly evacuated by use of the straps as handles to drag or carry the fireman to safety.

10 Claims, 4 Drawing Figures

QUICK EVACUATION FIREMAN'S COAT

BACKGROUND OF THE INVENTION

It is a fairly common occurrance for fireman to be overcome by fumes or injured by falling debris and rendered unable to extricate themselves from a hazardous area at the scene of a fire. When this occurs, of course the other fireman do their best to extricate their incapacitated peer by grabbing his clothing, throwing his arm over their neck, etc., and in any way possible dragging or carrying the fallen fireman clear of the smoke and flames to safety.

However, this is not always easy to do. In conditions where the floor surface may be littered with fallen beams and burning debris and visibility is poor, the fact that there is no positive, secure means of gripping the fallen fireman not only increases the time required to extricate him from the area, thus taking the rescuers out of the firefighting temporarily, but also, of course, risks injury to the rescuers as well as the downed man.

Additionally, with the demise of fireman's height limitations and the advent of women firefighters and lighter weight men firefighters entering the ranks, there will undoubtedly occur instances in which a lightweight firefighter may need to pull a downed body to safety that may be up to twice his or her own weight.

There is a need for a secure means of gripping and extricating a fallen fireman so that it may be done as safely and quickly as possible.

SUMMARY OF THE INVENTION

The instant invention fulfills the above stated need by providing a fireman's coat which is adapted by the incorporation of rugged straps at strategic positions so that rescuing firemen may grab the straps and, using them as handles, quickly and efficiently remove the man.

The straps are ideally positioned on the tops of the shoulders, behind the neck, and along the sides of the coat beneath the arms. To prevent theses straps from snagging on the projecting structure of the burning building, etc., ideally the straps should be releasably fastened to the coat somewhere intermediate their end points where they are fastened permanently to the coat fabric. In the illustrated embodiment this is done with Velcro® which is patched into the straps and the underlying fabric, or it may be stitched along the entire length of the straps and the underlying area of the coat.

DETAILED DESCRIPTION OF THE PREFERRED EMBODIMENT

Figure 1:
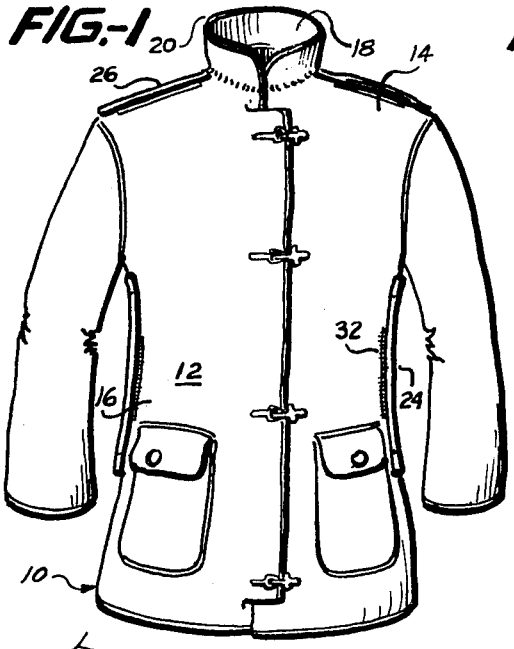
FIG. 1 is a front elevation view of the fireman's coat with the added straps.
Figure 2:
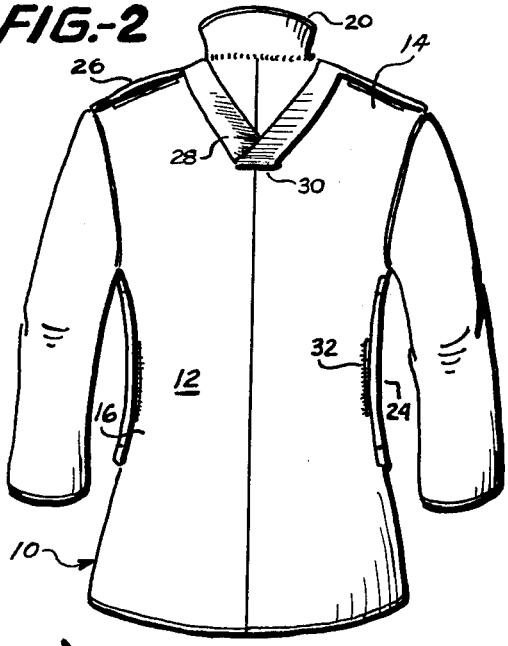
FIG. 2 is a rear elevation view of the fireman's coat showing the side straps, shoulder straps, and the V-shaped upper back strap behind the neck.

A conventional fireman's coat is shown at 10. The coat is made of a fabric which may or may not be woven, and is generally a synthetic which is tough, water repellant, and treated to be fire resistant. The coat has a trunk portion 12 with shoulder areas 14 and sides

16, and a neck opening 18 defined by a protective collar 20.

The straps that the instant invention adds to the coat need to be tough and flame resistant, and can be made of flame resistant Kevlar® of the ballistic type, or nylon webbing covered with Nomex® flame resistant cloth or the equivalent. The important features of the straps are that they be tough and flame resistant.

The straps are laid flat against the coat when they are sewn on so that in normal use they will lie flat, as opposed to looping up, which would be hazardous to the fireman. The ends of the straps are sewn down to the fabric of the coat with a crossed box stitch 22 which laps over one or more seams of the coat for purposes of strength. The side straps 24 parallel the sides 16 of the body of the coat and are stitched at top and bottom along a vertical side seam.

The shoulder straps 26 are stitched along both the shoulder seam, and at their outer ends, along the sleeve seam. At their inner ends, the shoulder straps are sewn to the shoulder seams and collar seams, and these ends are overlapped by the ends of the V-shaped neck strap 28 so that a single box stitch will retain one end of the back strap and the inner end of the respective shoulder strap down to two generally orthogonal seams behind the collar of the jacket.

Figure 4:
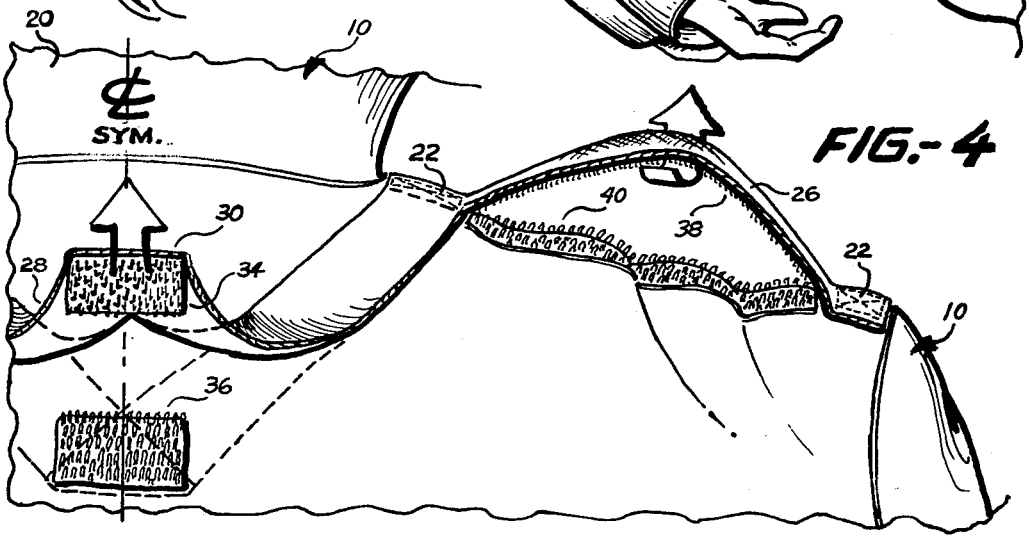
FIG. 4 is a detail of the shoulder and back straps illustrating their construction.

The V-shaped back strap is a single length of strap material bent over to define a V. The central bent part is stitched together, and the apex 30 which is so stitched also has means to releasably hold the strap down to the coat fabric. Otherwise, especially with this back strap, flapping around with the extreme danger of snagging would be possible. Although other means are conceivable, the apparent best means of temporarily fastening the straps down are Velcro patches such as patches 34 and 36 shown in FIG. 4 mounted to the vertex and underlying fabric of the coat. Also in FIG. 4, Velcro patches 38 and 40 may be seen, which are used for the same purpose. The side straps 24 should also have a Velcro patch 32 in the center.

Figure 3:
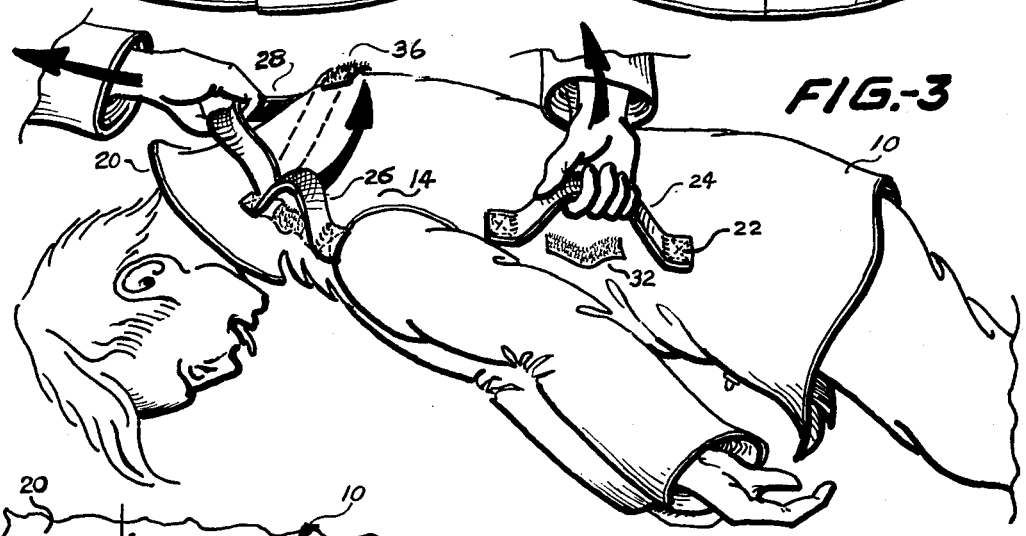
FIG. 3 illustrates the coat on a fallen fireman in one possible technique of use.

Alternative means of securing the straps down could include different Velcro arrangements, for example, a substantially continuous strip of Velcro as shown in FIG. 3 to further insure that snagging would not occur. The tradeoff, of course is, with a continuous Velcro strip, pulling the straps free for use as handles will become somewhat more difficult.

An alternative is, at least with the shorter, straight lengths of strap, to leave off any means of securing the central portion of the strap to the coat fabric. Although experimental use might prove central tie-downs unnecessary, it is believed that they are, in fact, necessary as fireman often crawl through holes in burning areas and brush up against things which would very quickly snag and possibly cause major problems if the straps aren't maintained fairly securely against the surface of the coat.

Although the term Velcro® has been used throughout the specification because this is the most prevalent, if not the only, hook and loop type fastener on the market, the term "hook and loop" is used in the claims to avoid trademark usage. Also, it should be noted that the coat fabric is expressly set forth in the claims, and this fabric could be either woven or unwoven sheet material of any type.

Although the straps could be positioned at various places, with those illustrated being exemplary of what appear to be the logical places, other strap arrangements are intended to be covered within the scope of the claims. In addition, other means of retaining the straps, and particularly the means for temporarily retaining the central portions of the strap against the fabric, are considered to be within the scope of the invention as conceived and the appended claims.

If put in general use, the coat according to the instant disclosure may or may not save lives, but will certainly save valuable seconds of fireman's time at the critical moments when fires are being fought and speed the evacuation of firemen from areas in which there may be collapsing roofs, falling beams, increasing levels of smoke or toxic flames, and other conditions under which a few saved seconds could well mean the difference between death or serious bodily injury and safety.

What is claimed is:

1. An emergency evacuation coat comprising:

(a) a fabric coat body having a trunk defining shoulders and a neck and sides;

(b) at least one strap secured at both ends at spaced positions on said body such that said strap tends to lie flat against said coat body, and releasable means for holding said strap against said coat body intermediate said ends such that said strap will normally be held flat against said fabric in use to prevent snagging and said releasable means can be released to permit the handle to be gripped in order to aid in dragging a wearer of said coat to safety under emergency conditions.

2. Structure according to claim 1 wherein said strap is shaped so as to form a V-outline when lying flat against said coat body with said releasable means arranged to hold said strap at the vertex thereof so that a longer effective length of strap is available for gripping purposes.

3. Structure according to claim 2 wherein said strap is mounted to said body behind and below the neck with the vertex depending.

4. Structure according to claim 1 wherein said means to hold comprises mating patches of hook and loop fastener material respectively fastened to said strap and the underlying fabric.

5. Structure according in claim 1 wherein said means to hold comprises mating lengths of hook and loop fastener material extending along substantially the entire length of said strap and the underlying fabric.

6. Structure according to claim 1 and including a plurality of rugged straps fastened to said body at both ends and positioned at various places on said body to provide gripping handles for rescue workers in several places on the body.

7. Structure according to claim 6 wherein two of said straps are longitudinally extended along the sides of said body.

8. Structure according to claim 7 and including two more straps extending along the tops of the shoulders of said body.

9. Structure according to claim 8 and further including a V-shaped strap behind the neck with the vertex depending down the back of said body.

10. Structure according to claim 9 wherein the ends of said V-shaped strap overlap the respective inner ends of said shoulder strap and are together stitched to said fabric.

* * * * *